US007638661B2

(12) United States Patent
Davenport et al.

(10) Patent No.: US 7,638,661 B2
(45) Date of Patent: Dec. 29, 2009

(54) POWER INCREASE AND INCREASE IN ACCELERATION PERFORMANCE OF DIESEL FUEL COMPOSITIONS

(75) Inventors: John Nicholas Davenport, Chester (GB); Raja Ahmad Sani Raja Salim, Chester (GB); Trevor Stephenson, Chester (GB); Nigel Peter Tait, Chester (GB)

(73) Assignee: Shell Oil Company, Houston, TX (US)

( * ) Notice: Subject to any disclaimer, the term of this patent is extended or adjusted under 35 U.S.C. 154(b) by 321 days.

(21) Appl. No.: 11/000,876

(22) Filed: Dec. 1, 2004

(65) Prior Publication Data

US 2006/0112614 A1 Jun. 1, 2006

(30) Foreign Application Priority Data

Dec. 1, 2003 (EP) ..... 03257555

(51) Int. Cl.
*C10L 1/16* (2006.01)
*C10L 1/04* (2006.01)

(52) U.S. Cl. ..... 585/14; 208/15

(58) Field of Classification Search ..... 585/14; 208/15

See application file for complete search history.

(56) References Cited

U.S. PATENT DOCUMENTS

| | | | | |
|---|---|---|---|---|
| 4,125,566 | A | 11/1978 | Trin Dinh et al. | 260/676 |
| 4,208,190 | A | 6/1980 | Malec | 44/53 |
| 4,478,955 | A | 10/1984 | Pesa | 518/713 |
| 2002/0151756 | A1* | 10/2002 | Schilowitz et al. | 585/14 |

FOREIGN PATENT DOCUMENTS

| | | |
|---|---|---|
| EP | 147240 | 7/1985 |
| EP | 147873 | 7/1985 |
| EP | 482253 | 4/1992 |
| EP | 557516 | 9/1993 |
| EP | 583836 | 2/1994 |
| EP | 613938 | 9/1994 |
| GB | 960493 | 6/1964 |
| GB | 2077289 | 12/1981 |
| NL | 204 491 | 11/1983 |
| WO | 97/12014 | 4/1997 |
| WO | 98/42808 | 10/1998 |
| WO | 01/48120 A1 | 7/2001 |
| WO | 02/084101 A1 | 10/2002 |

OTHER PUBLICATIONS

"The Shell Middle Distillate Synthesis Process", paper delivered at the 5th Synfuels Worldwide Symposium, Washington, DC, Nov. 1985.

"The Shell middle distillate synthesis process" by Maarten Van der Burgt, Jaap van Klinken, Tjong Sie, Nov. 1989.

International Search Report for PCT/US2004/053152 of Mar. 16, 2005.

* cited by examiner

*Primary Examiner*—Walter D Griffin
*Assistant Examiner*—Lessanework Seifu

(57) ABSTRACT

Use of a viscosity increasing component (ii) in provided in a composition (i) of a diesel fuel for the purpose of: improving the vehicle tractive effort (VTE) and/or acceleration performance of a compression ignition engine or a vehicle powered by such an engine, into which engine the composition (i) is introduced, or mitigating decrease in the vehicle tractive effort (VTE) and/or acceleration performance, in the case of a diesel fuel composition (i) to which an additional component (iii) is introduced for the purpose of improving the emissions performance, of a compression ignition engine or a vehicle powered by such an engine, into which engine the composition (i) is introduced.

4 Claims, 3 Drawing Sheets

POWER INCREASE AND INCREASE IN ACCELERATION PERFORMANCE OF DIESEL FUEL COMPOSITIONS

FIELD OF THE INVENTION

The present invention relates to diesel fuel compositions.

BACKGROUND OF THE INVENTION

Density is known to influence the performance power of some light duty (LD) vehicles through its influence on the injection process. Increasing fuel density increases mass of fuel injected where the injection technology meters fuel volumetrically. However increasing density also produces more black smoke and hydrocarbon emissions because it decreases the air/fuel ratio. For this reason the maximum fuel density permitted under the European Standard EN590 (2000) diesel specification was reduced from 860 to 845 kg/m$^3$ in 2000. In Sweden it is already the case that the minimum density specification has been relaxed below 820 kg/m$^3$ for Class 1 (Swedish Class 1 SwC1) and Class 2 environmentally adapted gasoils. Although the specification for SwC1 gasoil permits viscosity up to 4.0 mm$^2$/s (40° C.), fuel samples tend to have a viscosity of 2.0 mm$^2$/s or less.

There is a need to explore new environmentally acceptable ways to improve power performance in diesel fuels.

Generally traditional power performance high density fuels have been associated with a characteristic viscosity. An analysis of worldwide diesel fuels that have had density and viscosity measured in the last four years shows a trend to a characteristic viscosity with higher density, related by a linear trend:

density (kg/m$^3$)=12*viscosity (mm$^2$/s)+797. For this reason it has not been possible from available data to decouple the effects of density and viscosity and explore these independently of each other. It is difficult to change density and viscosity significantly by using standard refinery techniques or standard fuel components, and we have therefore devised a use of a special component blended into finished fuel to change the properties of blend density and blend viscosity.

SUMMARY OF THE INVENTION

Accordingly, in one embodiment, method is provided for the preparation of a composition (iv) of a diesel fuel comprising composition (i) and a viscosity increasing component (ii)

effective to improve the vehicle tractive effort (VTE) and/or acceleration performance of a compression ignition engine or a vehicle powered by such an engine, into which engine the composition (i) is introduced, or to mitigate decrease in the vehicle tractive effort (VTE) and/or acceleration performance, in the case of a diesel fuel composition (i) to which an additional component (iii) is introduced said component (iii) effective to improve the emissions performance, of a compression ignition engine or a vehicle powered by such an engine, into which engine the composition (i) is introduced, comprising blending the component (ii) with a diesel fuel comprising composition (i) to provide the composition (iv).

In another embodiment, a diesel fuel composition (iv) is provided comprising a diesel fuel and a viscosity increasing component (ii) wherein the composition has kinematic viscosity greater than or equal to 2.0 mm$^2$/s (40° C.) and density in the range 750 to 900 kg/m$^3$ wherein: either a) the composition is a diesel fuel composition having viscosity greater than 3.5 mm$^2$/s at 40° C. and having density in the range 780 to 900 kg/m$^3$, thereby the composition is useful as a high viscosity diesel fuel composition, for improving the vehicle tractive effort (VTE) and/or acceleration performance of a compression ignition engine or a vehicle powered by such an engine, into which engine the fuel composition is introduced, or for mitigating decrease in the vehicle tractive effort (VTE) and/or acceleration performance, in the case of a diesel fuel composition (iv) to which an additional component (iii) is introduced that improves the emissions performance, of a compression ignition engine or a vehicle powered by such an engine, into which engine the fuel composition (iv) is introduced; or b) the composition has kinematic viscosity greater than or equal to 2.0 mm$^2$/s (40° C.) and density in the range 750-820 kg/m$^3$ having acceleration performance equivalent to a fuel corresponding to European Standard EN 590 (2000); or c) the composition has kinematic viscosity greater than or equal to 2.0 mm$^2$/s (40° C.) and density in the range 820-900 kg/m$^3$ and the nature and amount of component (ii) is selected such that the viscosity of the composition is greater than that of the diesel fuel comprised in the composition (iv) and the density is less than that of the diesel fuel such that the composition has acceleration performance equivalent to a fuel corresponding to European Standard EN 590 (2000).

In another embodiment a method is provided for predicting relative acceleration performance for a diesel fuel composition with respect to its density and viscosity, said method comprising determining a desired density and/or viscosity and acceleration performance of the desired composition having regard to lines of equal acceleration performance on a plot of density against viscosity and/or equivalence coefficients for density and viscosity wherein each line of equal acceleration has a gradient m and/or equivalence coefficient is 1 mm$^2$/s=m kg/m$^3$.

BRIEF DESCRIPTION OF THE DRAWINGS

Advantages of the present invention will become apparent to those skilled in the art with the benefit of the following detailed description of embodiments and upon reference to the accompanying drawings, in which.

DETAILED DESCRIPTION OF THE INVENTION

Figure 1:
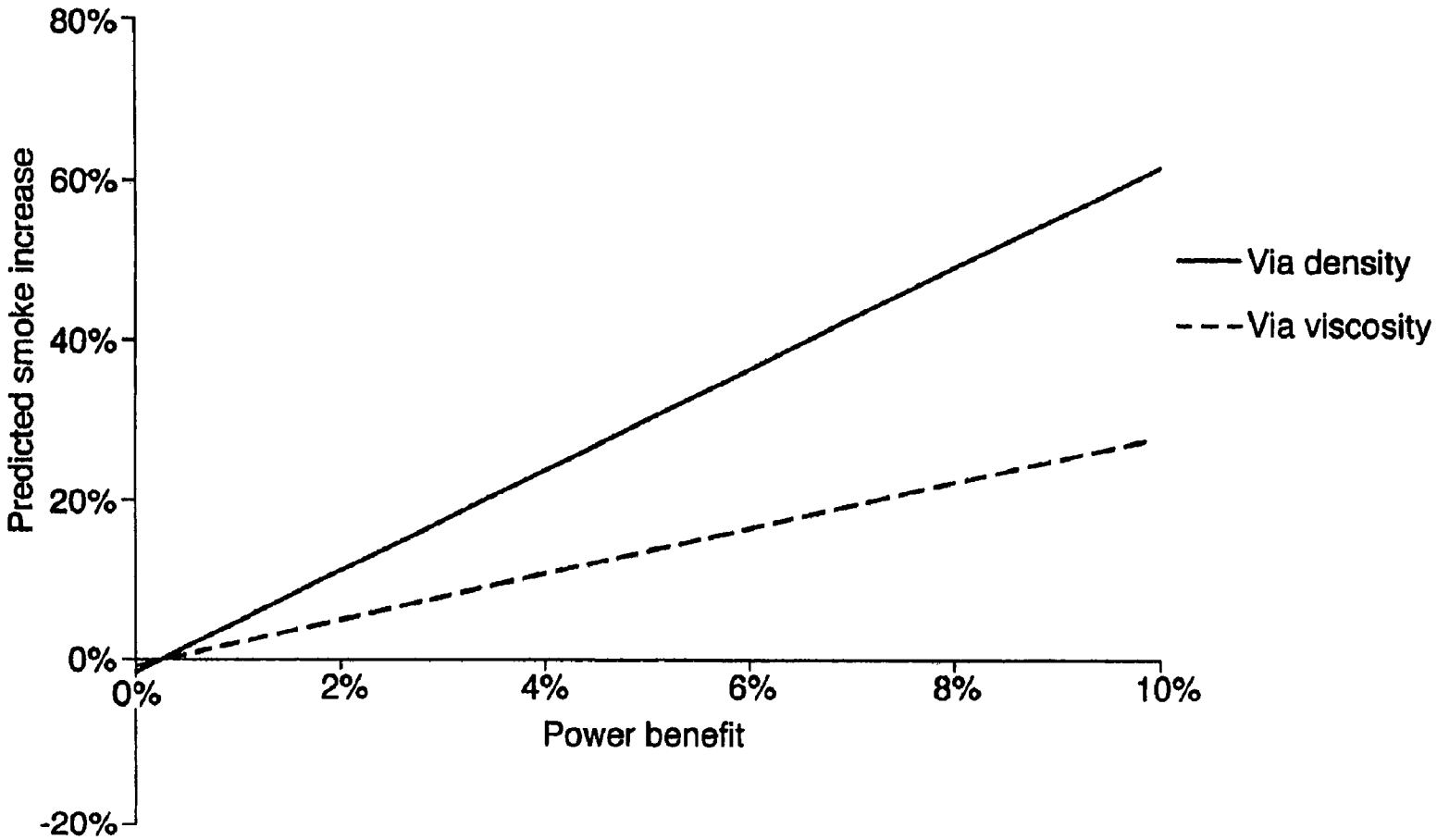
FIG. 1 is a graph of a percent predicted smoke increase versus percent power benefit through density and viscosity in a mixed IDI/DI fleet in Example 1.

The present invention relates to the use of a viscosity increasing component in a diesel fuel composition, a method for the preparation of a diesel fuel composition comprising a viscosity increasing component, a diesel fuel composition obtained thereby and a novel diesel fuel composition characterised by viscosity, a method for predicting acceleration performance of a diesel fuel composition with respect to its density and viscosity, and a method of operating a compression-ignition (diesel) engine using any such composition.

We have now found that VTE (vehicle tractive effort) (power) and resulting acceleration performance can be increased by raising the viscosity of diesel fuel; moreover that the increase in exhaust smoke per unit VTE increase is far less when fuel viscosity is increased than when fuel density is increased. We have moreover found that by increasing viscosity of a diesel fuel independently of density, density and viscosity can be traded-off against each other and almost completely account for variation between individual fuels whereby they are related by a common equivalence coefficient for density and viscosity 1 $mm^2/s$=m $kg/m^3$.

There is provided the use of a viscosity increasing component (ii) in a composition (i) of a diesel fuel, for the purpose of:

improving the vehicle tractive effort (VTE) and/or acceleration performance of a compression ignition engine or a vehicle powered by such an engine, into which engine the composition (i) is introduced, or mitigating decrease in the vehicle tractive effort (VTE) and/or acceleration performance, in the case of a composition (i) to which an additional component (iii) is introduced for the purpose of improving the emissions performance, of a compression ignition engine or a vehicle powered by such an engine, into which engine the composition (i) is introduced.

In one embodiment the invention provides the use of a viscosity increasing component (ii) in a composition (i) of a diesel fuel, effective to increase VTE and/or acceleration performance whilst providing a minimally deteriorated, neutral or better emissions performance, i.e. minimally increasing, maintaining or reducing the emissions level compared to that of the diesel fuel comprised in the composition (i).

In another embodiment the invention provides a viscosity increasing component (ii) in a composition (i) of a diesel fuel, to effectively mitigate decrease in VTE and/or acceleration performance, i.e. restoring at least in part VTE and/or acceleration performance decreased as a result of the presence of a component (iii) introduced for the purpose of improving emissions performance of the composition (i). A component (iii) may be any diesel fuel component having lower volumetric energy than the diesel fuel, and which is added to improve emissions performance of the composition (i) in known manner, but with the associated effect of reducing acceleration performance, which reduction is mitigated by the presence of viscosity increasing component (ii).

Preferably the component (ii) is effective in a low increase in exhaust smoke per unit VTE increase, preferably of less than or equal to 5.0 given as % AVL/% VTE, for the composition.

Preferably component (ii) is effective in regaining, at least in part, previous acceleration performance in a diesel fuel composition (i) which has been modified by the presence of component (iii) to decrease the emissions level compared to that of the diesel fuel comprised in the composition (i).

The invention may be performed in any way that results in a change in viscosity and an improvement in, or mitigation in decrease in, vehicle tractive effort (VTE) and/or acceleration performance.

In one embodiment of the invention, the resulting formulated fuels give demonstrably increased power (VTE) and shorter acceleration times, for example in a fuel or fuel blend containing a diesel fuel corresponding to the European Standard EN 590 (2000), for example an "ultra low sulphur diesel," Alternatively component (ii) is effective to ameliorate VTE losses that are associated with fuels or fuel blends which have a low volumetric energy, for example to give lower vehicle emissions, for example in a fuel or fuel blend containing a diesel fuel corresponding to the Swedish Class 1 standard, and conferring on such fuels a performance equivalent to that of a fuel corresponding to European Standard EN590 (2000) fuel; for example a use in a composition (i) of a diesel fuel and a low volumetric energy component (iii) causing lower vehicle emissions than for the diesel fuel, but decreased power (VTE) and increased acceleration times compared to the diesel fuel comprised in the composition (i), and conferring on such composition (i) an increase in power (VTE) and/or decrease in acceleration time compared to the diesel fuel including the component (iii), or a mitigation in decrease in power (VTE) and/or mitigation in increase in acceleration time compared to the diesel fuel including the component (iii).

Reference herein to European Standard EN 590 (2000) is to the European Standard "Automotive fuels—Diesel—Requirements and test methods" which specifies requirements and test methods for marketed and delivered automotive diesel fuel, and which sets a maximum fuel density of 845 $kg/m^3$ and a minimum viscosity of 2.0 $mm^2/s$. EN 590 was introduced to set a standard performance quality and emissions level. Accordingly the use of a viscosity increasing component (ii) of the invention preferably confers a performance at least equivalent to that of a diesel fuel having maximum density of 845 $kg/m^3$ and minimum viscosity of 2.0 $mm^2/s$.

We have found that a viscosity increasing component (ii) may be incorporated in a diesel fuel composition (i) as hereinbefore defined to increase the viscosity with resulting effect on VTE and/or acceleration performance with positive or neutral or minimally deteriorated emissions performance, and yet the resulting composition still meets the standards set by EN 590, whereby it is compatible with current standards in vehicle engine design and emissions levels and the like, and is a commercially useful composition.

One of the main drawbacks of using fuel density to boost power, as hereinabove referred, is the increase in emissions due to decreased air:fuel ratio. In a particular advantage of the present invention, we have found that emission performance for example measuring particulates emissions as smoke per unit power, which increases quite sharply with density, is almost independent of viscosity. This means that the more dense the diesel fuel the bigger the benefit of using viscosity instead of density to boost power.

By "emissions performance" is meant the amount of combustion-related emissions (such as particulates, nitrogen oxides, carbon monoxide, gaseous (unburned) hydrocarbons and carbon dioxide) generated by a diesel engine running on the relevant fuel or fuel composition.

A "neutral" emissions performance is achieved when the composition (i) causes the same level of emissions under a given set of test conditions (including engine type), as that generated by the diesel fuel comprised in the composition (i). A better than neutral performance is achieved when the level of emissions generated by the composition (i), under a given set of test conditions, is lower than that generated by the diesel fuel comprised in the composition (i). Such performance may be with respect to one or more of the types of emission referred to above.

Emission levels may be measured using standard testing procedures such as the European R49, ESC, OICA or ETC (for heavy-duty engines) or ECE+EUDC or MVEG (for light-duty engines) test cycles. Ideally emissions performance is measured on a diesel engine built to comply with the Euro II standard emissions limits (1996) or with the Euro III (2000), IV (2005) or even V (2008) standard limits.

The present invention may be applicable where the diesel fuel composition is designed for, used or intended to be used in any compression ignition engine, suitably in a direct injection (DI) diesel engine, for example of the rotary pump, in-line pump, unit pump, electronic unit injector or common rail type, or in an indirect injection (IDI) diesel engine. The fuel composition may be suitable for use in heavy- and/or light-duty diesel engines, emissions benefits being more marked in heavy-duty engines.

Preferably the invention is applicable to an IDI or a high speed (HSDI), high pressure-high speed (HP-HSDI), common Rail (CRDI) or electronic Unit (EUDI) direct injection engine, operating at pressure in the range 15 MPa or less to 150 MPa or more, more preferably an IDI or (HP) HSDI engine operating at 15 MPa or less to 100 MPa or more.

In a further aspect of the invention there is provided a method for the preparation of a composition (i) of a diesel fuel comprising a viscosity increasing component (ii) as defined above according to the present invention, which method comprises blending a component (ii) with a diesel fuel to provide a composition (i) as hereinbefore defined.

In practice it is difficult for a refinery to increase fuel density or viscosity because of the impact on other fuel properties. In a particular advantage of the invention, the method comprises blending a fuel composition outside the refinery, with use of a component (ii) as hereinbefore defined which may be any component which is non standard in a diesel specification, and which disrupts the density-viscosity relationship of the diesel fuel composition (i). Importantly the component (ii) has a high viscosity and this is in many cases sufficient to disrupt the density-viscosity relationship of the diesel fuel composition (i). The method may comprise constructing a diesel fuel composition by determining appropriate nature and amounts of component (ii) to blend with a known diesel fuel to give the desired composition. Density blending has been practised extensively in the art and techniques are known. Viscosity blending is known to be difficult because it is far from linear. With a binary mixture the low viscosity component is dominant, and using a component (ii) to increase the viscosity of a diesel fuel composition (i) falls within this technical area. Accordingly the method may therefore involve determining a blending index that can be combined linearly and then transformed back to give the solution. A linear solution may be determined as linear by mass or linear by volume or both and averaging the results. Known or proprietory blending indices are used by each person skilled in the art and it is therefore not necessary to provide a model index for the carrying out of the method of the invention. However for the avoidance of doubt, the skilled person is referred to ASTM D341 ("Standard viscosity temperature charts for liquid petroleum products") which describes a viscosity index and blending, and ISO 2909 ("Petroleum products–calculation of viscosity index from kinematic viscosity").

The diesel fuel composition (i) as hereinbefore defined may comprise a diesel fuel of conventional type, typically comprising liquid hydrocarbon middle distillate fuel oil(s), for instance petroleum derived gas oils. It may be organically or synthetically derived, and is suitably derived by distillation of a desired range of fractions from a crude oil. Such fuels comprised in diesel fuel composition (i) will typically have boiling points within the usual diesel range of 150 to 410° C., depending on grade and use.

The diesel fuel composition (i) may itself comprise a mixture of two or more different diesel fuel components. Typically the diesel fuel composition (i) includes cracked products, obtained by splitting heavy hydrocarbons.

Such diesel fuels comprised in diesel fuel composition (i) typically have a density from 750 to 900 kg/m$^3$ preferably from 800 to 860 kg/m$^3$ at 15° C. (e.g. ASTM D4502 or IP 365) and kinematic viscosity of 1.5 to 6.0 mm$^2$/s at 40° C. Density and viscosity are strongly correlated for distillate fuels, by virtue of their similar composition of aromatics and paraffin content. This means that selecting a diesel fuel by a desired increased or decreased density implies a corresponding increased or decreased viscosity.

The diesel fuel comprised in diesel fuel composition (i) suitably contains no more than 5000 ppmw (parts per million weight) of sulphur, is typically in the range 2000 to 5000 ppmw, or 1000 to 2000 ppmw, or alternatively up to 1000 ppmw, for example is a low or ultra low sulphur or sulphur free fuel, for instance containing at most 500 ppmw, preferably no more than 350 ppmw, most preferably no more than 100 or 50 or even 10 ppmw, of sulphur.

The diesel fuel composition (i) may be additivated as known in the art, and as hereinbelow defined.

As hereinbefore referred the component (ii) may be any component which is non standard in a diesel specification, and which disrupts the density-viscosity relationship of the diesel fuel composition (i), i.e. has a density and viscosity either or both of which are significantly different to those of the diesel fuel composition (i). The component (ii) is nevertheless suitably compatible with certain diesel specifications in order to blend effectively and perform effectively as part of a diesel fuel composition. Accordingly it is not necessary that the component (ii) is suitable for use as a diesel fuel, but suitably the component (ii) has a boiling range meeting that of a diesel fuel specification. Some high viscosity oils which might achieve the effect of increasing viscosity have a boiling range in excess of the diesel fuel specification and may therefore be less suitable.

Components of component (ii) (or the majority, for instance 95% w/w or greater, thereof) should therefore have boiling points within the typical diesel fuel ("gas oil") range, i.e. from about 150 to 490° C. for a higher boiling range oil or from 170 to 415° C. for a lower boiling range oil. It will suitably have a 90% w/w distillation temperature of from 300 to 470° C. or 300 to 400° C.

Suitably component (ii) comprises compounds which only contain hydrogen and carbon. A limited amount of contaminants such as sulphur containing compounds may be present. Preferably, more than 80 % wt of the components are compounds consisting of hydrogen and carbon only, more preferably more than 90 % wt.

Component (ii) used in the present invention is preferably selected from a Fischer-Tropsch derived component, an oil, and combinations thereof.

A Fischer-Tropsch derived component is preferably any suitable component derived from a gas to liquid synthesis, hereinafter a GtL component. A suitable GtL component may be selected from a kero, diesel or gasoil fraction as known in the art and may be generically classed as a synthetic process fuel or synthetic process oil.

An oil may be a mineral or synthetic oil, i.e., of mineral or synthetic origin, or a combination thereof.

A mineral oil is preferably selected from a mineral lubricating oil and a mineral process oil.

Mineral lubricating oils and process oils include, for example, liquid petroleum oils and/or are produced by solvent refining, acid treating or (severe) hydroprocessing (such as hydrocracking or hydrofinishing) and may be dewaxed by either a solvent or catalytic process. Mineral lubricating oils are sold by the Royal Dutch/Shell Group of Companies under the designations "HVI" or "MVIN".

A synthetic oil may be selected from any synthetic lubricating oil, i.e., a lubricating oil of synthetic origin. Synthetic lubricating oils are known or commercially available and include the type manufactured by the hydroisomerisation of wax, such as those sold by the Royal Dutch/Shell Group of Companies under the designation Shell XHVI™; and mixtures of $C_{10-50}$ hydrocarbon polymers and interpolymers, for example liquid polymers and interpolymers of alpha-olefins, conventional esters for example polyol esters, and the like. Preferably a synthetic lubricating base oil is selected from alpha-olefin oligomers, such as an octene-1 or decene-1 copolymer, dicarboxylic acid esters, such as di-2-ethylhexyl sebacate; and hindered ester oils, such as trimethylolpropane caprylate and pentaerythritol caproate, and other various synthetic oils, such as polyglycol oils, silicone oils, polyphenyl ether oils, halogenated hydrocarbon oils, and alkylbenzene oils.

A component (ii) comprising a Fischer-Tropsch derived component or an oil or mixture thereof as hereinbefore defined is suited to disrupting the density-viscosity relationship of the diesel fuel composition (i).

A particularly preferable component (ii) which is a Fisher Tropsch derived component is a GtL derived component, which may be a fuel or oil component as hereinbelow defined, and which may have for example viscosity of 3.6 $mm^2/s$ (40° C.) and density of 785.2 $kg/m^3$.

A particularly preferable component (ii) which is a mineral process or lubricating oil, is a mineral white oil; or is an oil such as HVI 55 having for example viscosity in the region of 19.2 $mm^2/s$ (40° C.) and density in the region of 851.2 $kg/m^3$; or is a process oil such as Gravex 925™ (Shell) which may have for example viscosity in the region of 30.6 $mm^2/s$ (40° C.) and density in the region of 906 $kg/m^3$; or is a severely hydroprocessed oil such as Ondina™ boiling in the range 315 to 400° C., and which may have for example viscosity in the region of 15.26 $mm^2/s$ (40° C.) and density in the region of 849 $kg/m^3$.

A particularly suitable component (ii) which is a synthetic lubricating oil, is a hydroisomerised slack wax obtained by the hydroisomerisation of wax such as Shell XHVI™.

The component (ii) may have any nature of specification such as sulphur content, cetane index and the like, depending on the amount which is to be used in a fuel composition according to the invention. For example it may be that a very preferable component (ii) for use in a particular diesel fuel composition (i) has high sulphur content of up to 10000 ppmw, but is used in low levels whereby the total increase in sulphur content of the diesel fuel composition is within the diesel fuel specification.

Preferably, the component (ii) comprising a GtL component or an oil as hereinbefore defined has a kinematic viscosity in the range of from 2 to 500 $mm^2/s$, preferably 10 to 200 $mm^2/s$ at 40° C., more preferably of from 20 to 100 $mm^2/s$.

A component (ii) is preferably present in an amount of from 0.5% v/v to 90% v/v, more preferably from 2% v/v to 90% v/v, more preferably from 5% v/v to 90% v/v, most preferably 10% v/v to 90% v/v.

A component (ii) which may be used in manner to achieve an increase in viscosity may be either a moderately high viscosity component which may be used in amounts of in excess of 25% such as from 30% or less to 70% or more, or a high viscosity component which may be used in amounts of less than 35% such as less than 3% to more than 30%. A component (ii) therefore typically has a density from 750 to 980 $kg/m^3$ at 15° C. (e.g. ASTM D4502 or IP 365) and kinematic viscosity of 3.5 to 500 $mm^2/s$. Preferably a high viscosity component (ii) has kinematic viscosity of 45 to 200 $mm^2/s$ (40° C.) or a moderately high viscosity component (ii) has kinematic viscosity of 3.5 to 45.0 $mm^2/s$ (40° C.). Preferably a component (ii) has a density of from 750 to 850 $kg/m^3$ more preferably of from 770 to 820 $kg/m^3$ and viscosity of from 3.5 to 6.0 $mm^2/s$, more preferably of from 3.5 to 5.5 $mm^2/s$. Alternatively a component (ii) has a density of from 800 to 950 $kg/m^3$ more preferably 820 to 915 $kg/m^3$ and a viscosity of from 6.0 to 45.0 $mm^2/s$, more preferably 12.0 to 40.0 $mm^2/s$, most preferably 15.0 to 35.0 $mm^2/s$ at 40° C.

The component (ii) may contain any level of sulphur for example up to 10000 ppmw and is suitably selected according to the amount to be used. The component (ii) may therefore be either a low or moderately high sulphur component which may be used in any desired amount such as amounts of in excess of 25% such as from 30% or less to 70% or more, or a high sulphur component which may be used in amounts of less than 35% such as less than 3% to more than 30%. The component (ii) may contain from in excess of 5000 ppmw (parts per million weight) of sulphur up to 10000 ppmw, or from in excess of 2000 ppmw to 5000 ppmw, or from 1000 ppmw to 2000 ppmw or may be a low or ultra low sulphur or sulphur free component, for instance containing at most 1000 ppmw, for example at most 500 ppmw, preferably no more than 350 ppmw, most preferably no more than 100 or 50 or even 10 ppmw, of sulphur.

The component (ii) may have a beneficial or otherwise properties for example may have a beneficial or poor cetane index. In a particular advantage a component (ii) may comprise a paraffinic oil which comprises a beneficial cetane number.

The component (ii) may itself comprise a mixture of two or more different viscosity increasing components, and/or be additivated as known in the art.

The component (ii) may be used in conjunction with an additional component (iii) which has been used to improve emissions performance of a diesel fuel composition (i) at the expense of power (VTE) and acceleration time, for example a Fischer-Tropsch derived gasoil of low density and moderate viscosity, and may mitigate the decrease in power (VTE) and/or acceleration performance without significantly increasing the emissions level.

By "Fischer-Tropsch" derived is meant that the component (ii) is, or derives from, a synthesis product of a Fischer-Tropsch condensation process. The Fischer-Tropsch reaction converts carbon monoxide and hydrogen into longer chain, usually paraffinic, hydrocarbons:

$$n(CO+2H_2)=(—CH_2—)_n+nH_2O+\text{heat},$$

in the presence of an appropriate catalyst and typically at elevated temperatures (e.g. 125 to 300° C., preferably 175 to 25° C.) and/or pressures (e.g. 0.5 to 10 MPa, preferably 1.2 to 5 MPa). Hydrogen:carbon monoxide ratios other than 2:1 may be employed if desired.

The carbon monoxide and hydrogen may themselves be derived from organic, inorganic, natural or synthetic sources, typically either from natural gas or from organically derived methane.

A viscosity increasing component (ii) as hereinbefore defined may be obtained directly from the refining or the Fischer-Tropsch reaction, or indirectly for instance by fractionation or hydrotreating of the refining or synthesis product to give a fractionated or hydrotreated product. Hydrotreatment can involve hydrocracking to adjust the boiling range (see e.g. GB-B-2077289 and EP-A-0147873) and/or hydroisomerisation which can improve cold flow properties by increasing the proportion of branched paraffins. EP-A-0583836 describes a two-step hydrotreatment process in which a Fischer-Tropsch synthesis product is firstly subjected to hydroconversion under conditions such that it undergoes substantially no isomerisation or hydrocracking (this hydrogenates the olefinic and oxygen-containing components), and then at least part of the resultant product is hydroconverted under conditions such that hydrocracking and isomerisation occur to yield a substantially paraffinic hydrocarbon fuel. The desired gas oil fraction(s) may subsequently be isolated for instance by distillation.

Other post-synthesis treatments, such as polymerisation, alkylation, distillation, cracking-decarboxylation, isomerisation and hydroreforming, may be employed to modify the properties of Fischer-Tropsch condensation products, as described for instance in U.S. Pat. No. 4,125,566 and U.S. Pat. No. 4,478,955.

Typical catalysts for the Fischer-Tropsch synthesis of paraffinic hydrocarbons comprise, as the catalytically active component, a metal from Group VIII of the periodic table of the elements, in particular ruthenium, iron, cobalt or nickel. Suitably such catalysts are described for instance in EP-A-0583836.

An example of a Fischer-Tropsch based process is the Shell™ "Gas-to-liquids" or "GtL" technology as hereinbefore referred, (formerly known as the SMDS (Shell Middle Distillate Synthesis) and described in "The Shell Middle Distillate Synthesis Process", van der Burgt et al, paper delivered at the 5th Synfuels Worldwide Symposium, Washington D.C., November 1985; and November 1989 publication of same title from Shell International Petroleum Company Ltd, London, UK). In the latter case, preferred features of the hydroconversion process may be as disclosed therein. This process produces middle distillate range products by conversion of a natural gas into a heavy long-chain hydrocarbon (paraffin) wax which can then be hydroconverted and fractionated.

The relative proportions of the diesel fuel comprised in the composition (i) and component (ii) and any other components or additives in the overall composition will depend on the exact nature of those components and the viscosity and density amongst other properties and/or acceleration and emissions amongst other performance factors desired of the composition. Preferably in the use or method of the invention, the amount of the component (ii) in the composition is 2% v/v or greater such as up to 90%; more preferably is 3% v/v to 90% v/v; more preferably is 3% to 25% or 10% v/v to 90% v/v; most preferably is 3% v/v or 5% v/v or 10% v/v to 20% v/v or 30% v/v to 77% v/v. The amount of component (ii) will be selected according to the desired viscosity increase and the viscosity increasing effect of the component itself, i.e., a moderately high or high viscosity component, as hereinbefore defined.

Particularly preferable compositions (i) contain (v/v):

a) from 90% to 95% diesel fuel and from 10% to 5% component (ii) as a highly refined mineral process oil or mineral lubricating oil as hereinbefore defined; or
b) from 5% to 50% diesel fuel and from 50% to 95% component (ii) as a GtL component as hereinbefore defined; or
c) from 2% to 50% diesel fuel and from 50% to 98% component (ii) as a mixture of from 10 to 25% of a highly refined mineral process oil or mineral lubricating oil as hereinbefore defined and from 40 to 85% of a GtL component as hereinbefore defined; or
d) from 2% to 50% diesel fuel and from 10% to 25% component (ii) as a highly refined mineral process oil or mineral lubricating oil as hereinbefore defined and from 40 to 85% of a component (iii) as a GtL component as hereinbefore defined.

In accordance with the present invention, the overall fuel composition may contain other diesel fuel components of conventional type, which again will typically have boiling points within the usual diesel range of 150 to 410° C.

The fuel composition may or may not contain additives, as hereinbefore referred which will typically be incorporated together with the diesel fuel comprised in the composition (i). Thus, the composition may contain a minor proportion (preferably less than 1% w/w, more preferably less than 0.5% w/w (5000 ppmw) and most preferably less than 0.2% w/w (2000 ppmw)) of one or more diesel fuel additives.

Generally speaking, in the context of the present invention any fuel component or fuel composition may be additivated (additive-containing) or unadditivated (additive-free). Such additive may be added at various stages during the preparation or production of a fuel composition; those added to a base fuel at the refinery for example might be selected from anti-static agents, pipeline drag reducers, flow improvers (e.g. ethylene/vinyl acetate copolymers or acrylate/maleic anhydride copolymers) and wax anti-settling agents (e.g. those commercially available under the Trade Marks "PARAFLOW" (e.g. PARAFLOW™ 450, ex Infineum), "OCTEL" (e.g. OCTEL™ W 5000, ex Octel) and "DODIFLOW" (e.g. DODIFLOW™ v 3958, ex Hoechst).

The fuel composition may for instance include a detergent, by which is meant an agent (suitably a surfactant) which can act to remove, and/or to prevent the build up of combustion related deposits within the engine, in particular in the fuel injection system such as in the injector nozzles. Such materials are sometimes referred to as dispersant additives.

Where the fuel composition includes a detergent, preferred concentrations lie in the range 20 to 500 ppmw active matter detergent based on the overall fuel composition, more, preferably 40 to 500 ppmw, most preferably 40 to 300 ppmw or 100 to 300 ppmw or 150 to 300 ppmw.

Examples of preferable detergent additives include polyolefin substituted succinimides or succinamides of polyamines, for instance polyisobutylene succinimides or polyisobutylene amine succinamides, aliphatic amines, Mannich bases or amines and polyolefin (e.g. polyisobutylene) maleic anhydrides. Succinimide dispersant additives are described for example in GB-A-960493, EP-A-0147240, EP-A-0482253, EP-A-0613938, EP-A-0557516 and WO-A-98/42808. Particularly preferred are polyolefin substituted succinimides.

Detergent-containing diesel fuel additives are known and commercially available, for instance from Infineum (e.g. F7661 and F7685) and Octel (e.g. OMA 413 OD).

Other components which may be incorporated in fuel additives, for instance in combination with a detergent, include lubricity enhancers such as P655 (ex-Infineum), OLI9000 (ex-Octel Corporation), fatty acid methyl esters (FAMES) and amide-based additives such as those available from the Lubrizol Chemical Company, for instance LZ 539 C; dehazers, e.g. alkoxylated phenol formaldehyde polymers such as those commercially available as NALCO™ EC5462A (formerly 7D07) (ex Nalco), and TOLAD™ 2683 (ex Petrolite); anti-foaming agents (e.g. the polyether-modified polysiloxanes commercially available as TEGOPREN™ 5851 and Q 25907 (ex Dow Corning), SAG™ TP-325 (ex Osi) and RHODORSIL™ (ex Rhone Poulenc)); ignition improvers (cetane improvers) (e.g. 2-ethylhexyl nitrate (EHN), cyclohexyl nitrate, di-tert-butyl peroxide and those disclosed in U.S. Pat. No. 4,208,190 at column 2 line 27 to column 3, line 21); anti-rust agents (e.g. that sold commercially by Rhein Chemie, Mannheim, Germany as "RC 4801", a propane-1,2-diol semi-ester of tetrapropenyl succinic acid, or polyhydric alcohol esters of a succinic acid derivative, the succinic acid derivate having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; reodorants; anti-wear additives; anti-oxidants (e.g. phenolics such as 2,6-di-tert-butylphenol, or phenylenediamines such as N,N'-di-sec-butyl-p-phenylenediamine); and metal deactivators.

Unless otherwise stated, the (active matter) concentration of each such additional component in the overall fuel composition is preferably up to 1% w/w, more preferably in the range from 5 to 1000 ppmw, advantageously from 75 to 300 ppmw, such as from 95 to 150 ppmw.

It is particularly preferred that a lubricity enhancer be included in the fuel composition, especially when it has a low (eg, 500 ppmw or less) sulphur content. The lubricity enhancer is conveniently present at a concentration of up to 1000 ppmw, preferably up to 1000 ppmw, based on the overall fuel composition. When present as a lubricity enhancer, a fatty acid methyl ester (FAME) may be present in the range 0.5 to 2%.

The (active matter) concentration of any dehazer in the fuel composition will preferably be in the range from 1 to 20 ppmw, more preferably from 1 to 15 ppmw, still more preferably from 1 to 10 ppmw and advantageously from 1 to 5 ppmw. The (active matter) concentration of any ignition improver present will preferably be 1000 ppmw or less, more preferably 600 ppmw or less, conveniently from 300 to 500 ppmw.

In a preferred embodiment the method of the invention is a method for constructing a composition (i) of a diesel fuel of equal or superior acceleration performance to the diesel fuel, or with mitigated decrease in acceleration performance compared to the diesel fuel modified by adding a component (iii) of lower volumetric energy than diesel fuel, by including a viscosity increasing component (ii) in a composition (i) optionally including a component (iii) as hereinbefore defined and comprises determining appropriate nature and amounts of component (ii) having regard to density and viscosity to give the desired composition (i). We have found that in the method for constructing a fuel of equal or superior acceleration performance, or with mitigated decrease in acceleration performance, comprising including a component (ii) in a diesel fuel composition (i), the smoke penalty per unit increase in power is less than that for the diesel fuel (i) whereby a decreased, neutral or minimally increased emissions level is achieved.

In the context of this and hereinbelow aspects of the invention, the composition (i) and components are as defined above in connection with the first aspect. Preferred features of this and the hereinbelow aspects, in particular regarding the nature and proportions of the components and their effect on the fuel properties and performance of compositions, may be as described in connection with the method of the first aspect. The aim in this and the hereinbelow aspects is in each case to determine or optimise the properties and performance of a two-component fuel composition (i), as compared to a diesel fuel component thereof, by the decoupling of density and viscosity. This may be done with the concurrent aim of achieving a density which is lower than that of the diesel fuel.

Preferably selecting a component (ii) by a desired increased or decreased density implies a corresponding increased viscosity which is greater than a corresponding increase for typical diesel fuels (i), or decreased viscosity which is less than a corresponding decrease for typical diesel fuels (i).

Accordingly the method of the invention provides a means to decouple fuel composition density and viscosity by blending an amount of a component (ii) as hereinbefore defined having higher viscosity and lower density than a diesel fuel, with the diesel fuel to provide a composition (i) of given viscosity and density.

Preferably the method is a method for constructing a fuel composition of density less than or equal to 820 kg/m$^3$ by blending an amount of a component (ii) as hereinbefore defined having higher viscosity and lower density with a diesel fuel of given viscosity and density greater than or equal to 820 kg/m$^3$, wherein the composition is characterised by acceleration performance equivalent to a fuel corresponding to European Standard EN 590 (2000) as hereinbefore defined.

The method of the invention for constructing a fuel composition (i) relies on the finding that density and viscosity can be traded-off against each other giving rise to a plurality of parallel lines of equal acceleration, or "iso-acceleration" lines, on a plot of density against viscosity represented by a common equivalence coefficient for density and viscosity whereby each "iso-acceleration" line has a gradient m for which the equivalence coefficient is 1 mm$^2$/s=m kg/m$^3$.

Preferably the method for constructing a composition (i) comprises selecting the amount or nature of diesel fuel and/or component (ii) having regard to lines of equal acceleration performance on a plot of density against viscosity and/or equivalence coefficients for density and viscosity characterised in that each line of equal acceleration has a gradient m and/or equivalence coefficient is 1 mm$^2$/s=m kg/m$^3$. Preferably m is 4 to 25, more preferably is 6 to 18, more preferably is 8 to 15, more preferably 10 to 14, more preferably approximately 12.0 and/or equivalence coefficient is 4 to 25, more preferably is 6 to 18, more preferably is 8 to 15 more preferably 10 to 14, more preferably approximately 12.

The method of the invention for constructing a composition (i) may be performed in any way that determines a change in any one of the above properties or performance parameter having regard to the two other property(ies) or performance parameter. The method may be a method for determining the performance properties of a composition (i) constructed with known density and viscosity, having regard to the performance of a known fuel, or may be a method for constructing a new fuel composition (i) of desired performance without constraint as to its density and viscosity specifications having regard to a known fuel.

Preferably the method comprises constructing a composition (i) and determining the density and viscosity thereof and locating on a plot of density versus viscosity on which is located a known fuel and the line of equal acceleration thereof, and determining whether the acceleration performance will be equal (on same line) or superior or inferior (above or below line);

or comprises constructing a composition (i) and determining the density and viscosity thereof and locating on a plot of density versus viscosity on which is located a plurality of known fuels and their iso-acceleration lines, and estimating the predicted relative acceleration performance by comparison of the distance of the location of the fuel of interest from a line of acceleration having regard to difference between any two iso-acceleration lines;

or comprises determining the density and viscosity of a known composition (i) giving known acceleration performance under known conditions and selecting a position on the same line of acceleration or determined having regard to the equivalence coefficient giving same acceleration but trading off viscosity and density, or selecting a position on a parallel "iso-acceleration" line giving a different acceleration and same or different free or constrained density and/or viscosity, and constructing a fuel accordingly.

More preferably the method for constructing a fuel composition (i) comprises:

a) comparing the relative location of a composition (i) to a line of equal acceleration performance of a known fuel; or b) selecting a desired density on a line of equal acceleration or having regard to the correlation coefficient of a known fuel having different density and desired acceleration performance, and identifying the viscosity at which it corresponds to the desired density; or c) selecting a desired viscosity on a line of equal acceleration or having regard to the correlation coefficient of a known fuel having different viscosity and desired acceleration performance, and identifying the density at which it corresponds to the desired viscosity; or d) determining an iso-acceleration line giving a desired acceleration performance having regard to the iso-acceleration line of a known fuel having an undesired acceleration performance, and determining a desired combination of density and viscosity of a locus on the desired iso-acceleration line in each case in which a line of equal acceleration or iso-acceleration line has a gradient m as hereinbefore defined or a correlation coefficient is 1 $mm^2/s$=m $kg/m^3$.

In a particular advantage of the method of the invention for constructing a composition (i) we have found that it is possible to decouple density and viscosity of diesel fuel compositions to positive effect in terms of being able to construct a new fuel by means of blending a diesel fuel and a component (ii), wherein density and viscosity are strongly correlated for diesel fuels such as distillate fuels and components (ii) have relatively high viscosity compared to diesel fuels, and that the decoupling enables advantage to be taken of a line of equal acceleration which exists across all diesel fuel compositions irrespective of density and viscosity, suitably in the range 750 to 900 $kg/m^3$ and 1.0 to 6.0 $mm^2/s$, more preferably 750 to 850 $kg/m^3$, most preferably 770 to 820 or 800 to 850 $kg/m^3$, and 2.0 to 4.5 $mm^2/s$ at 40° C., in which all lines have a similar gradient, i.e. all fuels are represented by "iso-acceleration" lines.

In a further aspect of the invention there is provided a diesel fuel composition (i) comprising a diesel fuel and a component (ii) wherein the composition has kinematic viscosity greater than or equal to 2.0 $mm^2/s$ (40° C.) and density in the range 750 to 900 $kg/m^3$ wherein: either a) the composition is a diesel fuel composition having viscosity greater than 3.5 $mm^2/s$ at 40° C. and having density in the range 780 to 900 $kg/m^3$, wherein the composition is intended for use as a high viscosity diesel fuel composition, for the purpose of:

improving the vehicle tractive effort (VTE) and/or acceleration performance of a compression ignition engine or a vehicle powered by such an engine, into which engine the fuel composition is introduced, or mitigating decrease in the vehicle tractive effort (VTE) and/or acceleration performance, in the case of a diesel fuel composition (i) to which an additional component (iii) is introduced for the purpose of improving the emissions performance, of a compression ignition engine or a vehicle powered by such an engine, into which engine the fuel composition (i) is introduced;

b) the composition has kinematic viscosity greater than or equal to 2.0 $mm^2/s$ (40° C.) and density in the range 750-820 $kg/m^3$ wherein the composition is characterised by acceleration performance equivalent to a fuel corresponding to European Standard EN 590 (2000) as hereinbefore defined; or c) the composition has kinematic viscosity greater than or equal to 2.0 $mm^2/s$ (40° C.) and density in the range 820-900 $kg/m^3$ and the nature and amount of component (ii) is selected such that the viscosity of the composition is greater than that of the diesel fuel comprised in the composition (i) and the density is less than that of the diesel fuel comprised in the composition (i) such that the composition is characterised by acceleration performance equivalent to a fuel corresponding to European Standard EN 590 (2000) as hereinbefore defined.

Preferably the composition is a diesel fuel composition (i) comprising a diesel fuel and a component (ii) which is suited to disrupting the density-viscosity relationship of the diesel fuel composition (i) and which is present in an amount of greater than or equal to 2% v/v wherein the component (ii) is selected from a Fischer-Tropsch derived component, an oil, and combinations thereof as hereinbefore defined, preferably wherein a Fischer-Tropsch derived component is any suitable component derived from a gas-to-liquids synthesis, hereinafter a GtL component, such as a kero, diesel or gasoil fraction as known in the art, and an oil may be a mineral or synthetic oil, i.e. of mineral or synthetic origin, or a combination thereof and is preferably selected from a mineral lubricating oil and a mineral process oil as hereinbefore defined, and a synthetic oil may be any synthetic lubricating oil, i.e. a lubricating oil of synthetic origin, and is preferably selected from lubricating oils such as those sold by the Royal Dutch/Shell Group of Companies under the designation Shell XHVI™, mixtures of $C_{10-50}$ hydrocarbon polymers and interpolymers, for example liquid polymers and interpolymers of alpha-olefins, conventional esters for example polyol esters, and the like as hereinbefore defined.

Preferably the composition comprises viscosity greater than 3.7 $mm^2/s$, most preferably greater than 3.8 $mm^2/s$. Preferably density is less than 850 $kg/m^3$. In one embodiment viscosity is preferably greater than 3.15 $mm^2/s$ and density less than 820 $kg/m^3$, or alternatively viscosity is greater than 3.4 $mm^2/s$ and density less than 830 $kg/m^3$, or alternatively viscosity is greater than 3.7 $mm^2/s$ and density less than 840 $kg/m^3$, more preferably less than 830 $kg/m^3$.

Preferably in b) above the composition is characterised in that in a plot of density versus viscosity a line of equal acceleration passing through the points viscosity=2.0 $mm^2/s$, density=820 $kg/m^3$ having a gradient m of up to 15.0, preferably up to 14.0, more preferably approximately 12.0 defines the minimum viscosity at any given density.

Preferably in c) above the composition is constructed having regard to the method employing one or more lines of equal acceleration performance and/or equivalence coefficients for density and viscosity as hereinbefore defined; more preferably having regard to the method comprising determining a desired density and viscosity of the desired composition having regard to lines of equal acceleration performance on a plot of density against viscosity and/or equivalence coefficients for density and viscosity characterised in that each line of equal acceleration has a gradient m and/or equivalence coefficient is 1 $mm^2/s$=m $kg/m^3$, and determining the amount and nature of component (ii) to give that density and viscosity, preferably comprises determining the nature of component (ii) selected from a component as hereinbefore defined.

In a further aspect of the invention there is provided a method for predicting relative acceleration performance for a desired diesel fuel composition with respect to its density and viscosity wherein the method comprises determining a desired density and/or viscosity and acceleration performance of the desired composition having regard to lines of equal acceleration performance on a plot of density against viscosity and/or equivalence coefficients for density and viscosity characterised in that each line of equal acceleration has a gradient m and/or equivalence coefficient is 1 $mm^2/s$=m $kg/m^3$. Preferably m is 4 to 25, more preferably is 6 to 18, more preferably is 8 to 15, more preferably 10 to 14, more preferably approximately 12.0 and/or equivalence coefficient is 4 to 25, more preferably is 6 to 18, more preferably is 8 to 15 more preferably 10 to 14, more preferably approximately 12.

The diesel fuel composition may be any known diesel fuel composition or may be a composition (i) comprising a diesel fuel and a viscosity increasing component (ii) as hereinbefore defined.

The method may be a method for determining the performance properties of a fuel composition constructed with known density and viscosity, having regard to the performance of a known fuel, or may be a method for designing a new fuel of desired performance without constraint as to its density and viscosity specifications having regard to a known fuel.

Preferably the method comprises determining the density and viscosity of a fuel of interest and locating on a plot of density versus viscosity on which is located a known fuel and the line of equal acceleration thereof, and determining whether the acceleration performance will be equal (on same line) or superior or inferior (above or below line);

or comprises determining the density and viscosity of a fuel of interest and locating on a plot of density versus viscosity on which is located a plurality of known fuels and their iso-acceleration lines, and estimating the predicted relative acceleration performance by comparison of the distance of the location of the fuel of interest from a line of acceleration having regard to difference between any two iso-acceleration lines;

or comprises determining the density and viscosity of a known fuel (i) giving known acceleration performance under known conditions and selecting a position on the same line of acceleration or determined having regard to the equivalence coefficient giving same acceleration but trading off viscosity and density, or selecting a position on a parallel "iso-acceleration" line giving a different acceleration and same or different free or constrained density and/or viscosity.

In a particular advantage of the method of the invention for predicting relative acceleration performance for a fuel composition we have found that it is possible to decouple density and viscosity of diesel fuel compositions to positive effect in terms of being able to predict fuel composition acceleration performance by means of blending a diesel fuel (i) and a component (ii), wherein density and viscosity are strongly correlated for diesel fuels (i) such as distillate fuels and components (ii) have relatively high viscosity compared to diesel fuels (i), and that the decoupling enables advantage to be taken of a line of equal acceleration which exists across all diesel fuel compositions irrespective of density and viscosity, suitably in the range 750 to 900 kg/m$^3$, more preferably 750 to 850 kg/m$^3$, more preferably 770 to 820 or 800 to 850 kg/m$^3$ and 1.0 to 6.0 mm$^2$/s, more preferably 2.0 to 4.5 mm$^2$/s at 40° C., in which all lines have a similar gradient, i.e. all fuels are represented by "iso-acceleration" lines.

In a further aspect of the invention there is provided a method of operating a compression ignition engine, and/or a vehicle which is driven by a diesel engine, which method involves introducing into a combustion chamber of the engine a diesel fuel composition (i) obtained with the use or method of the invention as hereinbefore defined and comprising a diesel fuel and a component (ii) as hereinbefore defined.

The present invention will now be illustrated by way of following example, illustrating the effects on the responsiveness and emissions of an engine, and using and by reference to the accompanying drawings that are provided for illustration and are not to be construed as limiting the invention.

FIG. 1 shows association of smoke increase with power increase through density and viscosity respectively in a mixed IDI/DI fleet in Example 1.

Figure 2:
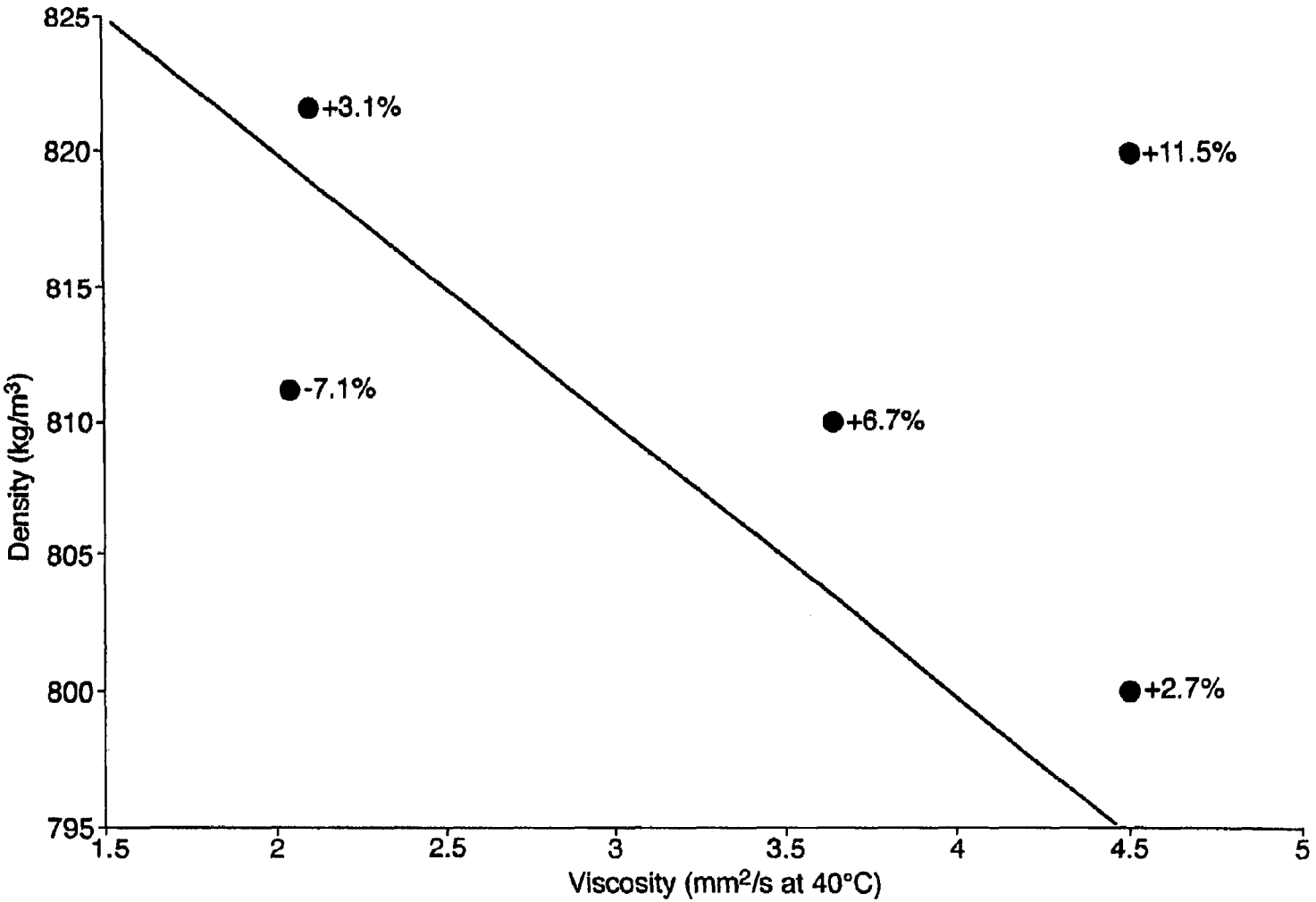
FIG. 2 is a graph showing effect on acceleration time in a diesel engine varying density and viscosity of the fuels in Example 2.

FIG. 2 shows the effect of varying density and viscosity on acceleration time in an Audi 2.5 L direct injection diesel bench engine in Example 2.

Figure 3:
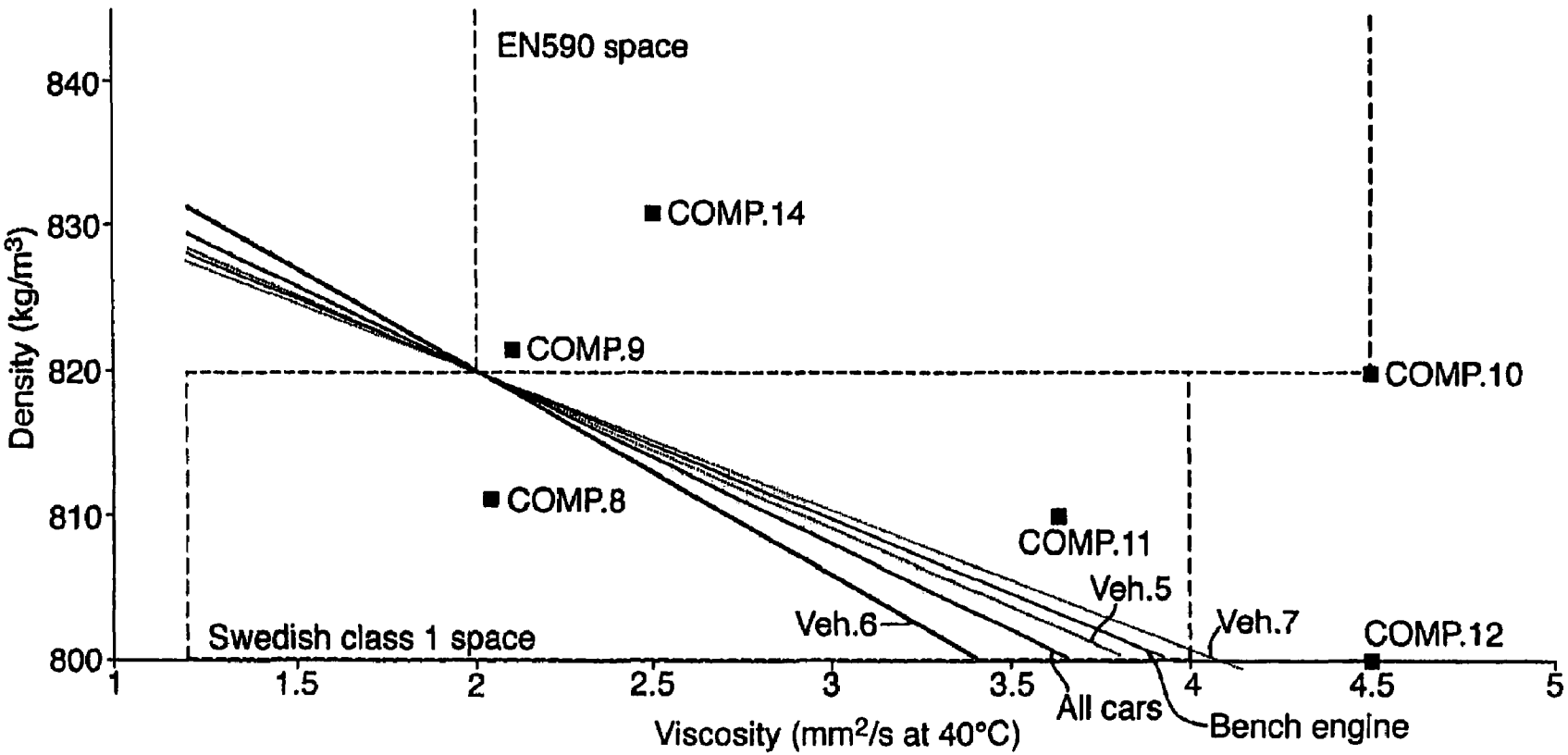
FIG. 3 is a graph showing lines of equal acceleration time established for the bench engine of FIG. 2 and a mixed fleet of cars in Example 2.

FIG. 3 shows lines of equal acceleration time (through 820 kg/m$^3$ and 2.0 mm$^2$/s) established for the bench engine of FIG. 2 and a mixed fleet of cars in Example 2.

EXAMPLE 1

Test Fuels

The fuels used in the tests were a selection of five fuels, four of which, F1, F2, F4 and F5 lie close to the maxima and minima of the European Standard EN590 specification having ranges of 820-845 kg/m$^3$ for density and 2.0-4.5 mm$^2$/s at 40° C. for viscosity, with an additional fuel F3 at the centre of the range. The properties of fuels F1-F5 are shown in Table 1:

TABLE 1

| | F1 | F2 | F3 | F4 | F5 |
|---|---|---|---|---|---|
| Density @ 15° C. (IP365/ASTM) D4502), kg/m$^3$ | 841 | 821 | 836 | 844 | 829 |
| Distillation (IP123/ASTM D86) | | | | | |
| IBP/° C. | 162 | 191 | 157 | 164 | 156 |
| T50/° C. | 253 | 243 | 286 | 300 | 338 |
| T90/° C. | 321 | 294 | 385 | 386 | 390 |
| FBP/° C. | 367 | 319 | 403 | 404 | 405 |
| Cetane number (ASTM D613) | 52.8 | 57.2 | 55.5 | 51.0 | 58.0 |
| Cetane Index (IP364/84/ASTM D976) | 49.6 | 51.0 | 55.7 | 55.5 | 64.8 |
| Kinematic viscosity @ 40° C. (IP71/ASTM D445), mm$^2$/s | 2.4 | 2.1 | 3.25 | 4.25 | 4.45 |
| Sulphur (ASTM D2622), mg/kg | 297 | 10 | 311 | 370 | 68 |
| Aromatic content (IP391 Mod), % m | 21.7 | 21.5 | 17.5 | 17.4 | 7.8 |

Test Compositions

In the following tests, compositions 1, 2, 4, 6 and 7 comprised Fuels F1 to F5 above and compositions 3 and 5 comprised Fuels F2 (minimum density and viscosity) and F3 (centre of range) containing 15% v/v of naphthenic process oil Gravex 925 and solvent dewaxed paraffinic oil HVI55 respectively, both Gravex 925 and HVI55 being deeply hydrotreated oils. Details of Gravex 925 and HVI55 are shown in Table 2:

TABLE 2

| | Gravex 925 | HVI55 |
|---|---|---|
| Density, kg/m$^3$ | 907 | 851 |
| Distillation | | |
| T10/° C. | 344 | 359 |
| T50/° C. | 361 | 403 |
| T90/° C. | 384 | 446 |
| CN | 38 | 71 |
| Kinematic viscosity @ 40° C., mm$^2$/s | 30.6 | 19.2 |
| Sulphur, mg/kg | 383 | 4 |

TABLE 2-continued

| | Gravex 925 | HVI55 |
|---|---|---|
| Monoaromatics | 39.3 | 21.9 |
| Di + aromatics | 6.0 | 10.3 |

Details of compositions 1 to 7 are shown in Table 3

TABLE 3

| Fuel Composition | Composition | Density @ 15° C. (IP365/ASTM D4502), kg/m$^3$ | Kinematic viscosity @ 40° C. (IP71/ASTM D445), mm$^2$/s |
|---|---|---|---|
| 1 | Pure F1 | 841 | 2.4 |
| 2 | Pure F2 | 821 | 2.1 |
| 3 | F2 +15%v/v Gravex baseoil | 834 | 2.7 |
| 4 | Pure F3 | 836 | 3.25 |
| 5 | F3 + 15% v/v HVI55 | 839 | 4.2 |
| 6 | Pure F4 | 844 | 4.25 |
| 7 | Pure F5 | 829 | 4.45 |

Fleet

Vehicle tests used a fleet of four diesel cars representing a range of modern rotary pump injection technologies: indirect injection (IDI) and high speed direct injection (HSDI). Details of the vehicles chosen for the tests are shown in Table 4:

TABLE 4

| | Veh 1 | Veh 2 | Veh 3 | Veh 4 |
|---|---|---|---|---|
| Injection | IDI | IDI | HSDI | HSDI |
| Max injection pressure (MPa) | <15 | <15 | >17.5 | >17.5 |
| Injection technology | Indirect injection | indirect injection | High speed direct injection | High speed direct injection |
| Turbo? | Y | N | Y | Y |

Acceleration and Power Tests

Each vehicle underwent a single day of tests with all seven fuels. In addition the central reference fuel was run at the start, middle and end of each days tests, so that any gradual shifts in engine performance could be identified and corrected. For each fuel the following tests were carried out: Acceleration tests, Power tests and Smoke measurements.

Acceleration: Wide Open Throttle (WOT)

Average WOT acceleration times (seconds) are given in Table 5.

TABLE 5

| Fuel Composition | Veh 1 | Veh 2 | Veh 3 | Veh 4 |
|---|---|---|---|---|
| 1 | 16.88 | 20.28 | 12.31 | 13.38 |
| 2 | 18.17 | 21.42 | 12.56 | 14.21 |
| 3 | 16.81 | 20.28 | 12.09 | 13.21 |
| 4 | 16.68 | 20.37 | 11.99 | 13.06 |
| 5 | 16.19 | 19.90 | 11.90 | 12.71 |
| 6 | 16.10 | 19.91 | 11.66 | 12.69 |
| 7 | 16.70 | 20.54 | 11.88 | 13.08 |

WOT acceleration times were found to decrease steadily with increasing density and increasing viscosity. Two analyses were carried out on the above data. The first of these was to look at the effect of an average fuel on the individual vehicles. This was done by fitting individual regression equations of the form:

$$\text{Acceleration time}=A.\text{density}+B.\text{viscosity}+C$$

Where A, B and C are constants, to obtain a regression value $R^2$.

In all cases the value of $R^2$ was greater than 0.95, showing a high level of agreement, and the equations were used to calculate the % acceleration benefit in terms of density (per 1 kg/m$^3$ density increase) and viscosity (per 1 mm$^2$/s viscosity increase) for each vehicle at 50, 85 and 100 kph and average.

These results showed that:

The response to density was uniform for all vehicles as expected, with the exception of Veh 3;

All four vehicles responded to fuel viscosity and the response of the four vehicles was not uniform. The two IDI vehicles (Veh 1 and 2) give a very different response to viscosity though their behaviour with density was very similar, and the behaviour of Veh 3 while still remarkably constant was much closer to Veh 4 than it was for density.

The second analysis was to look at the fleet average response to each of the fuels. This was done by taking the measured performance benefits relative to one of the fuels and fitting an equation of the form:

$$\%\ \text{benefit}=D.\Delta\rho+E.\Delta\nu+F$$

where ρ=density (kg/m$^3$), ν=viscosity (mm$^2$/s) and D, E and F are constants.

Fixing the reference points at 820 kg/m$^3$ and 2.0 mm$^2$/s viscosity meant that the benefits were relative to the minimum density and viscosity of the European Standard EN590 formulation space. The average acceleration time benefit could then be expressed as equation 1:

$$\textit{ave accel}\ \text{benefit}\ (\%)=0.215\Delta\rho+1.8065\Delta\nu-0.10842$$

In this expression density and viscosity are both statistically significant at the 99% level.

Power (VTE)

Steady state power (VTE) measurements were carried out at 2000, 2600 and 3300 rpm at 50, 85 and 100 kph. The results mirrored the acceleration time data, and once again the raw data were of very high quality. The results are shown in Table 6:

TABLE 6

| Fuel Composition | Veh 1 | Veh 2 | Veh 3 | Veh 4 |
|---|---|---|---|---|
| 1 | 34.49 | 32.37 | 66.58 | 51.67 |
| 2 | 32.74 | 31.25 | 65.22 | 49.32 |
| 3 | 34.41 | 31.78 | 67.55 | 52.16 |
| 4 | 34.63 | 32.24 | 68.25 | 54.45 |
| 5 | 35.44 | 32.19 | 68.80 | 53.87 |
| 6 | 35.62 | 32.42 | 69.30 | 53.76 |
| 7 | 34.55 | 32.10 | 68.25 | 52.14 |

A similar analysis was carried out, to examine the behaviour of each vehicle to the overall fuel set, and each fuel to the overall set of vehicles. The VTE response was very similar to that seen for acceleration times.

Fitting an equivalent expression to that used for acceleration benefit gives equation 2:

$$ave\ VTE \text{ benefit } (\%)=0.19042\Delta\rho+1.5058\Delta\nu-0.25791$$

In this expression density and viscosity are again both statistically significant at the 99% confidence level, and a fleet average response was predicted for the fuels, given in Table 6a:

TABLE 6a

| Fuel Composition | Predicted % VTE benefit |
|---|---|
| 1 | 4.4 |
| 2 | 0.2 |
| 3 | 3.6 |
| 4 | 4.6 |
| 5 | 6.5 |
| 6 | 7.5 |
| 7 | 5.0 |

Smoke Measurements: AVL Filter Smoke Tests

AVL filter smoke measurements were conducted in 5th gear in the 100 kph tests. An AVL 405 smokemeter was used, which draws a fixed volume of exhaust gas though a filter paper, darkening the paper. The amount of smoke is assessed by comparing the amount of light reflected from the test paper with the amount reflected from fresh paper.

AVL smoke measurements are given in Table 7.

TABLE 7

| Fuel Composition | Veh 1 | Veh 2 | Veh 3 | Veh 4 |
|---|---|---|---|---|
| 1 | 2.56 | 4.38 | 1.93 | 2.33 |
| 2 | 1.96 | 3.76 | 1.48 | 1.99 |
| 3 | 2.25 | 4.06 | 1.82 | 2.53 |
| 4 | 2.45 | 4.40 | 1.93 | 2.38 |
| 5 | 2.50 | 4.75 | 1.84 | 2.56 |
| 6 | 2.61 | 4.88 | 2.07 | 2.81 |
| 7 | 2.09 | 4.50 | 1.79 | 2.46 |

Looking at the fleet average smoke increases, the AVL results give the expression of equation 3:

$$\%\text{ smoke filter increase}=1.2065\Delta\rho+4.3827\Delta\nu-2.7928$$

In this expression density and viscosity are again both statistically significant at the 99% level, and a fleet average response was predicted for the fuels, given in Table 7a:

TABLE 7a

| Fuel Composition | Predicted % AVL smoke penalty |
|---|---|
| 1 | 24.9 |
| 2 | 0 |
| 3 | 18.0 |
| 4 | 23.1 |
| 5 | 28.6 |
| 6 | 34.8 |
| 7 | 18.3 |

Smoke Measurements—Celesco Opacity

Celesco opacity results were measured in 3rd, 4th and 5th gear during the 50, 85 and 100 kph acceleration time tests. A Celesco opacimeter was used, which passes a light beam through the exhaust gas. Smoke in the exhaust gas causes some of the light to be absorbed or scattered. The instrument is calibrated in pure air, and the amount of smoke in the exhaust gas is expressed as the fraction of light absorbed/scattered.

The opacity tests measure the visible obscuration due to the particles in the smoke, and the peak opacity is derived from a continuous readout during the acceleration.

Average Celesco smoke opacity measurements are given in Table 8:

TABLE 8

| Fuel Composition | Veh 1 | Veh 2 | Veh 3 | Veh 4 |
|---|---|---|---|---|
| 1 | 9.60 | 12.17 | 9.84 | 12.17 |
| 2 | 6.37 | 10.44 | 8.10 | 10.44 |
| 3 | 7.40 | 10.27 | 8.75 | 10.27 |
| 4 | 9.84 | 12.04 | 10.11 | 12.04 |
| 5 | 9.35 | 12.99 | 9.79 | 12.99 |
| 6 | 12.01 | 13.85 | 12.77 | 13.85 |
| 7 | 9.08 | 11.96 | 7.83 | 11.96 |

The fleet average predictions are given by the expression of equation 4:

$$\%\text{ opacity increase}=1.8601\Delta\rho+10.421\Delta\nu-11.030$$

which has density significant at the 95% confidence level and viscosity significant at 90%. A fleet average penalty was predicted for the fuels, given in Table 8a:

TABLE 8a

| Fuel Composition | Predicted % AVL smoke penalty |
|---|---|
| 1 | 33.2 |
| 2 | −6.5 |
| 3 | 23.7 |
| 4 | 30.9 |
| 5 | 45.5 |
| 6 | 55.1 |
| 7 | 30.3 |

Smoke Per Unit Power

This is key to the usefulness of the fuel compositions of the invention and indicates whether, if power is boosted to a certain level by increasing fuel density, more or less smoke is generated than by using viscosity to boost power to the same extent. Using equations 1 and 2 above, which model VTE (power) and filter smoke as a function of density and viscosity change, from equation 2, keeping viscosity constant, the average power benefit P, can be expressed in terms of density change:

$$\Delta\rho = \frac{P+0.25791}{0.19042}$$

and keeping density constant, the average power benefit P, can be expressed in terms of viscosity change:

$$\Delta\nu = \frac{P+0.25791}{1.5058}$$

These equations can be used to calculate the density and viscosity changes required to attain particular power levels. Inserting these values into equation 2 gives the corresponding smoke predictions which are as shown in FIG. 1. From FIG. 1 it is clear that using density to increase the fleet average power creates about twice the smoke penalty as using viscosity.

These responses can also be shown varying from fuel to fuel across the formulation space. To do this the AVL smoke penalty per unit power increase was calculated by dividing the AVL penalty by the averaged VTE benefit giving the following equation 5:

$$\%\ \text{smoke increase per unit power} = 0.11014\Delta\rho + 0.25305\Delta v + 3.5509.$$

A fleet average response was predicted for the fuels, given in Table 9:

TABLE 9

| Fuel Composition | Predicted % AVL/ % VTE |
|---|---|
| 1 | 5.82 |
| 2 | 3.75 |
| 3 | 4.99 |
| 4 | 4.96 |
| 5 | 4.96 |
| 6 | 5.52 |
| 7 | 3.90 |

As FIG. 1 illustrates the smoke per unit power increases quite sharply with density but it almost independent of viscosity. This means that the more dense the base fuel, the bigger the benefit of using viscosity instead of density to boost power. The lack of a viscosity effect does not mean that viscosity is irrelevant but that the effect of viscosity in raising average power is constant, and that a graph of fleet average power against viscosity would be linear.

This work represents the first correlation of the viscosity and density effects and has determined for the first time a very significant relation which can be used to important effect in blending compositions in the future, in selecting fuels for blending based not only on their emissions performance and engine cleaning effect but also on a desired VTE (power) or acceleration performance.

EXAMPLE 2

Test Fuels

The fuels used in the tests were a Swedish Class I fuel SC1, and an existing high density low viscosity gasoil fuel D1 including cetane improver EHN to bring this value closer to SC1, and compositions containing varying proportions of an ultra low sulphur diesel (ULSD) fuel F6 and a Fischer-Tropsch (GtL) derived component F7 and mineral oil Ondina OD. A comparative fuel, Composition 14, used in some tests was a standard ULSD. The properties of fuels F6, F7, oil OD and diesel fuels SC1 and D1 are shown in Table 10:

TABLE 10

| | SC1 | D1 | F6 | F7 | OD | 14 |
|---|---|---|---|---|---|---|
| Density @ 15° C. (IP365/ASTM D4502), kg/m$^3$ | 811.2 | 821.6 | 850.3 | 785.2 | 849.0 | 830.3 |
| Distillation (IP123/ASTM D86) | | | | | | |
| IBP/° C. | 188.8 | 189.0 | 201.0 | 211.5 | 316.0 | 156.5 |
| T50/° C. | 235.8 | 242.5 | 290.0 | 298.0 | 363.5 | 267.0 |
| T90/° C. | 270.3 | 291.5 | 337.5 | 339.0 | 387.5 | 319.0 |
| FBP/° C. | 290.3 | 319.0 | 363.5 | 354.5 | 400.0 | 344.0 |
| Cetane number (ASTM D613) | 58.6 | 58 | 51.1 | >74.8 | 62.2 | 53.5 |
| Cetane Index (IP364/84/ASTM D976) | 52.9 | | 51.5 | 77.2 | 59.4 | 53.0 |
| Kinematic viscosity @ 40° C. (IP71/ASTM D445), mm$^2$/s | 2.041 | 2.100 | 3.689 | 3.606 | 15.260 | 2.5 |
| Sulphur (ASTM D2622), mg/kg | <5 | 10 | 400 | 5 | 1.5 | 32 |
| Aromatic content (IP391 Mod), % m | 3 | 21.6 | 32.3 | 0 | 0 | 0 |

Fuel F7 had been obtained from a Fischer-Tropsch (GtL) derived component via a two-stage hydroconversion process analogous to that described in EP-A-0583836.

Test Compositions

In the following tests, compositions 10, 11 and 12 containing respective amounts of F6, F7 and OD were compared with fuels Sc1 and D1. Table 11 compares the content of each of fuels Sc1 and D1 and compositions 10, 11 and 12:

TABLE 11

| Fuel Composition | Sc1 | D1 | F6 | F7 | OD |
|---|---|---|---|---|---|
| 8 | Pure Sc1 | | | | |
| 9 | | Pure D1 | | | |
| 10 | | | 35% | 46% | 19% |
| 11 | | | 38% | 62% | |
| 12 | | | 4% | 77% | 19% |

Details of compositions 10, 11 and 12 are shown in Table 12:

TABLE 12

| | 10 | 11 | 12 |
|---|---|---|---|
| Density @ 15° C. (IP365/ASTM D4502), kg/m$^3$ | 820.0 | 810.0 | 800.0 |
| Cetane Index (IP364/84/ASTM D976) | 64.8 | 67.4 | 72.8 |
| Cetane Number (IP380/94/ASTM D613-91) | 76.4 | 77.0 | 88.3 |
| Kinematic viscosity @ 40° C. (IP71/ASTM D445), mm$^2$/s | 4.500 | 3.637 | 4.500 |
| Sulphur (ASTM D2622), mg/kg | 143 | 155 | 20 |
| Aromatic content (IP391 Mod), % m | 11.3 | 12.3 | 1.3 |

Compositions 10, 11 and 12 were prepared in 200 L drums by splash blending, i.e. the component in the smaller quantity is introduced first and this is then topped up with the component in the larger quantity to ensure good mixing.

Test Engine

The engine used in the tests described below was a turbocharged 2.5 L direct injection diesel engine, Eng 1. However it is emphasised that any suitable engine could be used to demonstrate the advantages of the present invention.

The test engine had the specification set out in Table 13:

TABLE 13

| | |
|---|---|
| Type | Eng 1 2.5 TDI AAT Compression Ignition |
| Number of cylinders | 5 |
| Swept volume | 2460 cm$^3$ |
| Bore | 81.0 mm |
| Stroke | 95.5 mm |
| Nominal compression ratio | 21.0:1 |
| Maximum charge pressure | 165 kPa @ 4000 rpm |
| Maximum power (boosted) | 115 brake horsepower (85.8 kilowatts) @ 4000 rpm (DIN) |
| Maximum torque (boosted) | 265 Nm (DIN) @ 2250 rpm |

Its fuel injection equipment (Bosch™) had the following specification:

Nozzle and injector assembly: Bosch 0 432 193 786

Nozzle opening pressure: 19 to 20 MPa, single stage

Injection pump: Bosch VEL 400 Part No. 0 460 415 998

No modifications of the fuel injection system were made on installation on to a bench stand. The fuel injection system is essentially identical to that on the road vehicle.

Measurement of Acceleration

Speed calculations were made using a 60-tooth wheel and a magnetic pick-up. A computer converted a frequency signal generated by this equipment to rpm.

A signal from the in-cylinder pressure transducer was measured with HSDA (High Speed Data Acquisition Apparatus) to calculate IMEP (Indicated Mean Effective Pressure).

The responsiveness of the engine to the different fuels/compositions was tested in wide open accelerations.

20 full throttle accelerations were conducted on each fuel/composition each day of which the first 10 were discarded because the engine temperature rises during the accelerations. The engine was stabilised at 1300 rpm and low load. The throttle was then snapped open and the dynamometer load increased to simulate the inertia of an accelerating vehicle. The time elapsed from the time the throttle was pressed to the time that the engine passed through six speed "gates" (i.e. 1500, 1700, 2000, 2500, 3000 and 3800 rpm) was averaged for each set of 10 accelerations and the results are shown in Table 14, given by fuel density and viscosity, and plotted in FIG. 2.

TABLE 14

| Fuel Composition | Viscosity | Density | Acceleration time | % benefit* |
|---|---|---|---|---|
| 8 | 2.041 | 0.8112 | 6.50 | −7.1 |
| 9 | 2.100 | 0.8216 | 5.88 | 3.1 |
| 10 | 4.500 | 0.8200 | 5.37 | 11.5 |
| 11 | 3.637 | 0.8100 | 5.66 | 6.7 |
| 12 | 4.500 | 0.8000 | 5.90 | 2.7 |

*with respect to 2.0 mm$^2$/s and 820 kg/m$^3$

It can be seen from FIG. 2 that the differences in acceleration times were considerable and the density viscosity tradeoff is clearly visible.

Composition 12 with density 800 kg/m$^3$ and 4.5 mm$^2$/s viscosity had almost the same engine acceleration as Composition 9 with density 821 kg/m$^3$ and 2.1 mm$^2$/s viscosity i.e. composition 12 has a much lower density but much higher viscosity than composition 9. Composition 11 with density 810 kg/m$^3$ and 3.637 mm$^2$/s viscosity, had a shorter engine acceleration than composition 9 and 12 where composition 11 has a density and viscosity between those of 9 and 12. Composition 10 with density 820 kg/m$^3$ and 4.5 mm$^2$/s viscosity had dramatically faster engine acceleration than 11 and 9 and 12, 10 has a much higher viscosity than 9. All of 9, 10, 11 and 12 had faster acceleration times than 8.

It can therefore be seen that the difference in viscosity between the compositions compensated for a difference in density.

A linear regression fit of acceleration time with density and viscosity has an $R^2$ value of 87% is included in FIG. 2 showing that density and viscosity account for most for the variation between the fuels, i.e. that for any given fuel lying on this or a parallel regression line, or line of equal acceleration, other fuels may be blended with compensating differences in viscosity and density, lying on the regression line and they will provide equivalent acceleration.

Chassis Dynamometer Testing

Vehicle tests used a fleet of direct-injection diesel cars representing a range of modern diesel technologies: unit injector and rotary distributor pump. Details of the vehicles chosen for the tests are shown in Table 15:

TABLE 15

| | Veh 5 | Veh 6 | Veh 7 |
|---|---|---|---|
| Turbo charged | Yes | Yes | yes |
| EGR | Yes | Cooled | yes |
| Inter-cooled | Yes | Yes | Yes |
| DI/IDI | DI | DI | DI |
| Max injection pressure (MPa) | ~50 | 110 | 205 |
| Injection technology | VE-EDC (rotary inj. Distributor Pump) | Rotary pump, ECD, solenoid controlled fuel injection | Electronic Unit Injection |
| Pilot injection | No | No | yes |
| Pre injection | No | Yes | no |
| Euro emissions level | 1 | 3 | 3 |
| Adjustable start of injection (1) | yes | Yes | Yes |
| Adjustable start of injection (2) | no | No | no |

Test Method

All testing was conducted on chassis dynamometers. The vehicles were tested using standard road load. All data were recorded at 25 Hz to capture details of the transient response of the vehicles. The test chamber was held at 20+/−2° C.

Vehicle responsiveness was measured using a series of full throttle accelerations in 3rd, 4th and 5th gear in the speed range 1500-3500 rpm. The vehicle was stabilised prior to acceleration testing by running in 5th gear at 1500 rpm until the sump oil temperature stabilised (at about 95° C.). Three acceleration runs were conducted on each fuel and the mean acceleration time plotted.

All the fuels tested in the bench engine were also tested in the cars. In addition composition 14 (ULSD) was also tested at the start and end of each working day to provide a check on baseline drift.

It was possible to average the percentage benefit, shown with respect to 820 kg/m$^3$ and 2.0 mm$^2$/s, across all vehicles even though the acceleration times vary with power/weight ratio. The results are shown in Table 16.

TABLE 16

| | 3rd gear | 4th gear | 5th gear | All gears |
|---|---|---|---|---|
| 14 | 3.3% | 3.7% | 4.7% | 4.0% |
| 8 | −1.6% | −1.5% | −2.6% | −2.1% |
| 9 | 0.3% | 0.5% | 0.7% | 0.6% |
| 10 | 3.3% | 4.1% | 4.4% | 4.1% |
| 11 | 1.4% | 1.5% | 2.2% | 1.8% |
| 12 | 2.1% | 2.1% | 2.5% | 2.3% |

Regression Fit

A regression line was fitted to the data in terms of $\Delta\rho$, the difference in density from the value 820 kg/m$^3$, and $\Delta\nu$, the difference in viscosity from the value 2.0 mm$^2$/s.

The regression coefficients are listed in Table 17, showing the percentage improvement in acceleration time that would result for a density change ($\Delta\rho$) of 1 kg/m$^3$ and a viscosity change ($\Delta\nu$) change of 1 mm$^2$/s.

The size of the coefficients indicates the sensitivity of the engine to changing fuel properties. These show the absolute size of the difference that varying density and viscosity would have in a vehicle. Whilst there is variation between vehicles, the gradients are sufficiently similar to be useful in a method for designing a specification for a diesel fuel composition for any cars.

The gradient m is the ratio of the two coefficients, showing how density can be traded for viscosity for equal performance. It can be seen that, on average, the ratio, expressed as gradient of a line of equal acceleration, is 12.0, i.e. a change of 1 mm$^2$/s in viscosity is equivalent to a change of about 12 kg/m$^3$ in density.

TABLE 17

| Coefficients of regression fit | $\Delta\rho$ 1 kg/m$^3$ = | $\Delta\upsilon$ 1 mm$^2$/s = | Gradient, m (1 mm$^2$/s = m kg/m$^3$) |
|---|---|---|---|
| Eng 1 2.5 Tdi bench | 0.52% | 5.33% | 10.3 |
| Veh 7 | 0.12% | 1.12% | 9.6 |
| Veh 6 | 0.21% | 3.02% | 14.1 |
| Veh 5 | 0.18% | 1.96% | 10.8 |
| All cars | 0.17% | 2.04% | 11.9 |

The regression lines show the lines of equal acceleration according to the invention. It is expected that, at least in the area defined by the test fuels, density and viscosity can be traded-off against each other giving rise to a family of "iso-acceleration" lines parallel to the lines shown.

Previous studies have shown that engines are density sensitive. The present invention shows that the relative viscosity insensitivity leads to only a small variation in gradient of line of equal acceleration performance for different engines and this is particularly significant in a method for selecting a fuel composition specification according to the invention as hereinbefore defined.

The concept of equal acceleration performance of Example 2 could also be applied to the results of Example 1 above whereby it is further confirmed that this concept is universally applicable irrespective of vehicle or engine type and density or viscosity range of fuel. In the results of Example 1 it can be seen that a line of equal acceleration may be drawn through the results if presented graphically and would show that in the higher density range of 820 to 850 kg/m$^3$ of Example 1 the results from the direct injection tests in the lower density range of 800 to 820 kg/m$^3$ of Example 2 are upheld. In the case of Example 1 the result would give a gradient of 8.4, in the area density is 820 to 840 kg/m$^3$ and viscosity is 2.0 to 4.5 mm$^2$/s. The results could in principle be plotted as in FIG. 3.

We claim:

1. A method for preparing a diesel fuel composition by selecting components with respect to its density and viscosity by the relative acceleration performance of the diesel fuel composition, said method comprising: (a) selecting a diesel fuel composition; (b) plotting density against viscosity and/or equivalence coefficients for density and viscosity of said diesel fuel composition wherein in said plot each line of equal acceleration has a gradient m and/or equivalence coefficient is 1 mm$^2$/s=m kg/m$^3$ wherein m is 4 to 25; (c)determining the desired density and/or viscosity and acceleration performance of the desired diesel fuel composition having regard to lines of equal acceleration performance on said plot and (d) introducing a viscosity increasing component to the diesel fuel composition in an amount effective to obtain the desired viscosity.

2. The method of claim 1 wherein m is 6 to 18.

3. The method of claim 1 wherein m is 8 to 15.

4. the method of claim 2 m is 10 to 14.

* * * * *